US007926901B2

(12) United States Patent
Ito

(10) Patent No.: US 7,926,901 B2
(45) Date of Patent: Apr. 19, 2011

(54) INKJET RECORDING APPARATUS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 686 days.

(21) Appl. No.: 12/014,469

(22) Filed: Jan. 15, 2008

(65) Prior Publication Data

US 2008/0170091 A1 Jul. 17, 2008

(30) Foreign Application Priority Data

Jan. 17, 2007 (JP) ..... 2007-008060

(51) Int. Cl.
*B41J 29/393* (2006.01)

(52) U.S. Cl. ..... 347/19; 347/17

(58) Field of Classification Search ..... 347/9–11, 347/17, 19, 68
See application file for complete search history.

(56) References Cited

U.S. PATENT DOCUMENTS

| | | | |
|---|---|---|---|
| 4,275,402 | A | 6/1981 | Kern |
| 6,273,537 | B1 | 8/2001 | Hiwada |

FOREIGN PATENT DOCUMENTS

| | | | |
|---|---|---|---|
| EP | 0318328 | A2 | 5/1989 |
| JP | H10-217463 | A | 8/1998 |
| JP | 2000-079680 | A | 3/2000 |
| JP | 2002036568 | A | 2/2002 |
| JP | 2002-234161 | A | 8/2002 |
| JP | 2006-255975 | A | 9/2006 |

OTHER PUBLICATIONS

Japanese Patent Office, Japanese Office Action issued in corresponding Japanese Application No. 2007-008060, dated Nov. 25, 2008.
European Search Report in Application No. EP 08000879 (counterpart to the above-captioned U.S. patent application) mailed Mar. 17, 2009.
European Patent Office; European Search Report in Application No. 08000879.0 counterpart to the above-captioned U.S. patent application mailed Jun. 3, 2009.

*Primary Examiner* — Lamson D Nguyen
(74) *Attorney, Agent, or Firm* — Baker Botts L.L.P.

(57) ABSTRACT

An inkjet recording apparatus includes a passage unit; an actuator unit including a plurality of individual electrodes; a plurality of waveform output circuits which output pulse signals to be supplied to the plurality of individual electrodes; one or more variable resistance elements connected to the actuator unit; a temperature sensor which detects environmental temperature; and a controller which controls the one or more variable resistance elements so that the one or more variable resistance elements decrease in their resistance values with a decrease in the environmental temperature detected by the temperature sensor.

7 Claims, 11 Drawing Sheets

INKJET RECORDING APPARATUS

CROSS REFERENCE TO RELATED APPLICATION

The present application claims priority from Japanese Patent Application No. 2007-8060, which was filed on Jan. 17, 2007, the disclosure of which is herein incorporated by reference in its entirety.

BACKGROUND OF THE INVENTION

1. Field of the Invention

The present invention relates to an inkjet recording apparatus in which ink droplets are ejected to print.

2. Description of Related Art

An inkjet head included in an inkjet printer for printing on a recording medium by ejecting ink droplets includes a passage unit on which nozzles are formed for ejecting ink droplets and in which pressure chambers are formed which are connected to the respective nozzles; a piezoelectric actuator for giving ejection energy to ink in each pressure chamber; and a driver IC for outputting a driving signal to drive the piezoelectric actuator. The piezoelectric actuator serves to change the volume of each pressure chamber and thereby give pressure to ink in the pressure chamber. Japanese Patent Unexamined publication No. 2002-36568 discloses an piezoelectric actuator including a piezoelectric sheet positioned over a plurality of pressure chambers; individual electrodes positioned to be opposed to the respective pressure chambers; and a common electrode fixed at a reference potential and positioned to be opposed to the individual electrodes through the piezoelectric sheet. When the driver IC of the piezoelectric actuator gives a driving pulse signal to an individual electrode of the actuator, an electric field is generated at the portion of the piezoelectric sheet sandwiched by the individual electrode and the common electrode, along the thickness of the sheet. As a result, the thickness of that portion of the piezoelectric sheet increases to decrease the volume of the corresponding pressure chamber, and thereby pressure is given to ink in the pressure chamber.

SUMMARY OF THE INVENTION

The viscosity of ink used in such an inkjet head varies in accordance with a change in environmental temperature. Specifically, lowering of the environmental temperature brings about an increase in the viscosity of ink while rising of the environmental temperature brings about a decrease in the viscosity of ink. An increase in the viscosity of ink leads to reduction in the amount of ink to be ejected from each nozzle and reduction in the ejection velocity from the nozzle. Because a change in the viscosity of ink thus causes changes in ink ejection characteristics, including the ink ejection amount and the ink ejection velocity, it is difficult to control variations in the ink ejection characteristics over a wide temperature range.

On the other hand, manufacturing variation may cause variation in the pulse voltage to be output from the driver IC to the piezoelectric actuator. The variation in the pulse voltage brings about variations in the charge/discharge characteristics, including rise time Tr and fall time Tf, of capacitors each constituted by two electrodes sandwiching the piezoelectric sheet, which lead to variations in ink ejection characteristics. Therefore, it is desirable to select driver ICs in any of which its pulse voltage falls within a predetermined range, and to use only the selected driver ICs. However, this reduces the yield of driver ICs and thus increases the manufacturing cost of apparatuses. To overcome this problem, it is thinkable not to select driver ICs whose pulse voltages fall within the predetermined range but to connect in series to the common electrode a resistor having a fixed resistance value that can offset variations in the charge/discharge characteristics of capacitors in the piezoelectric actuator caused by variation in the pulse voltage. In actual use of an inkjet head, however, the number of individual electrodes in one piezoelectric actuator, to which pulse signals are to be given at once, changes in accordance with the number of nozzles from which ink droplets are to be ejected at once. Therefore, even in the above case in which the resistor is connected to the common electrode, because the number of capacitors in the piezoelectric actuator, to be activated by pulse signals applied, changes in accordance with the number of nozzles from which ink droplets are to be ejected at once, this varies the time constant of the CR circuit constituted by each capacitor and the resistor. This varies the charge/discharge characteristics of capacitors in the piezoelectric actuator. As a result, ink ejection characteristics also vary accordingly.

An object of the present invention is to provide an inkjet recording apparatus in which variation in ink ejection characteristics has been suppressed over a broad temperature range.

Another object of the present invention is to provide a low-cost inkjet recording apparatus in which ink ejection characteristics scarcely vary even when the number of nozzles changes from which ink droplets are to be ejected at once.

According to an aspect of the present invention, an inkjet recording apparatus comprises a passage unit in which a plurality of individual ink passages each leading to a nozzle via a pressure chamber are formed; an actuator unit comprising a plurality of individual electrodes related to the respective pressure chambers, a common electrode, and a piezoelectric layer interposed between the plurality of individual electrodes and the common electrode; a plurality of waveform output circuits which output pulse signals to be supplied to the plurality of individual electrodes; one or more variable resistance elements connected to the actuator unit; a temperature sensor which detects environmental temperature; and a controller which controls the one or more variable resistance elements so that the one or more variable resistance elements decrease in their resistance values with a decrease in the environmental temperature detected by the temperature sensor.

According to the invention, when the viscosity of ink has increased due to a decrease in environmental temperature, the one or more variable resistance elements decrease in their resistance values. This decreases the time constants CR of a plurality of CR circuits constituted by a plurality of capacitors in the actuator unit and the one or more variable resistance elements. The decrease in the time constant of each CR circuit brings about increases in ink ejection amount and ejection velocity. Conversely, when the viscosity of ink has decreased due to an increase in environmental temperature, the one or more variable resistance elements increase in their resistance values. This increases the time constants of the CR circuits constituted by the plurality of capacitors in the actuator unit and the one or more variable resistance elements. The increase in the time constant of each CR circuit brings about decreases in ink ejection amount and ejection velocity. Because the time constants of the CR circuits are thus controlled so as to offset the variations in the ink ejection characteristics caused by the variation in the viscosity of ink due to a change in environmental temperature, the variations in the ink ejection characteristics can be suppressed over a broad temperature range.

According to another aspect of the present invention, an inkjet recording apparatus comprises a passage unit in which a plurality of individual ink passages each leading to a nozzle via a pressure chamber are formed; an actuator unit comprising a plurality of individual electrodes related to the respective pressure chambers, a common electrode, and a piezoelectric layer interposed between the plurality of individual electrodes and the common electrode; a plurality of waveform output circuits which output pulse signals to be supplied to the plurality of individual electrodes; one or more variable resistance elements connected to the actuator unit; and a controller which controls the one or more variable resistance elements so that the one or more variable resistance elements decrease in their resistance values with an increase in the number of pulse signals to be output at once from the plurality of waveform output circuits.

As the number increases of pulse signals to be output at once from the plurality of waveform output circuits, the one or more variable resistance elements decrease in their resistance values. This decreases the time constants of the CR circuits constituted by the plurality of capacitors in the actuator unit and the one or more variable resistance elements. On the other hand, the increase in the number of pulse signals to be output at once from the plurality of waveform output circuits brings about an increase in the number of capacitors in the actuator unit to be activated by the pulse signals applied. This increases the time constants of the CR circuits constituted by the activated capacitors and the one or more variable resistance elements. As a result, the time constants of the CR circuits are prevented from widely varying. Conversely, as the number decreases of pulse signals to be output at once from the plurality of waveform output circuits, the one or more variable resistance elements increase in their resistance values. This increases the time constants of the CR circuits. On the other hand, the decrease in the number of pulse signals to be output at once from the plurality of waveform output circuits brings about a decrease in the number of capacitors in the actuator unit to be activated by the pulse signals applied. This decreases the time constants of the CR circuits constituted by the activated capacitors and the one or more variable resistance elements. As a result, also in this case, the time constants of the CR circuits are prevented from widely varying. Because the one or more variable resistance elements are thus changed in their resistance values so as to suppress the variations in the time constants of the CR circuits caused by a change in the number of nozzles to eject ink droplets at once, the ink ejection characteristics scarcely vary even when the number of nozzles to eject ink droplets at once is changed. In addition, for the use of components such as driver ICs including the plurality of waveform output circuits, it is not necessary to select only those in which the pulse voltages are within a predetermined range. This realizes the manufacture of apparatuses at low cost.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
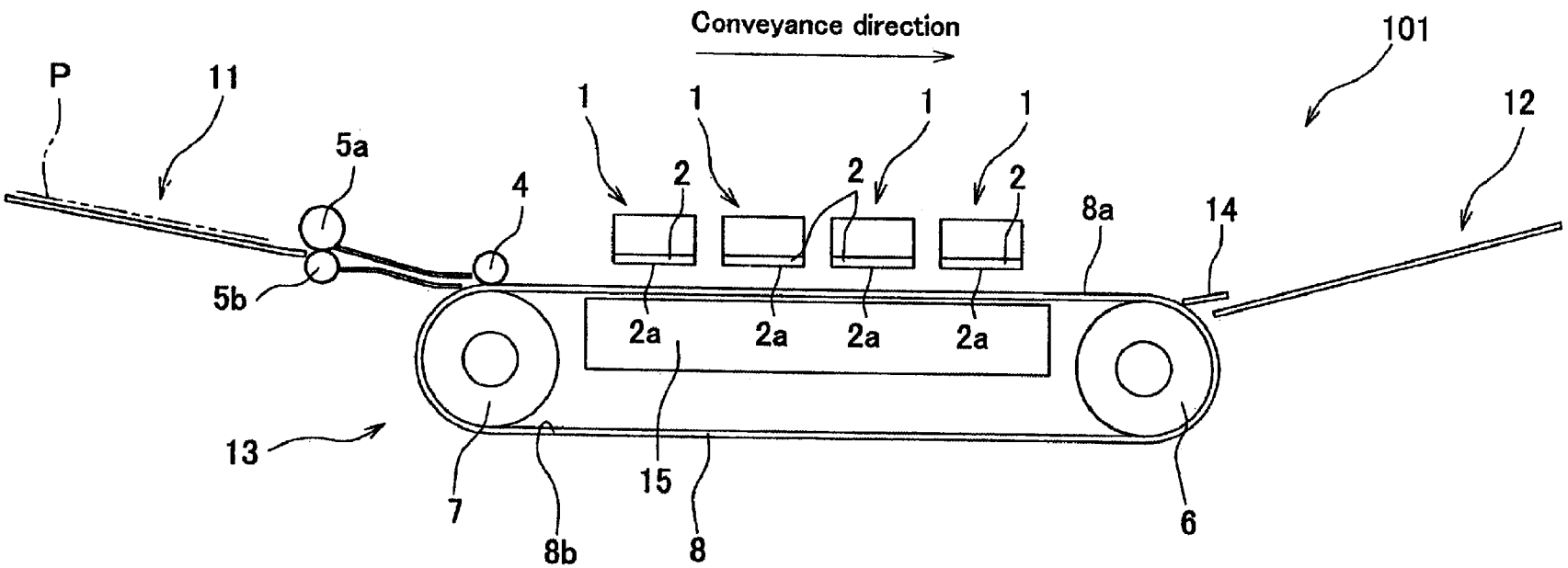
FIG. 1 is a side view of an inkjet printer according to an embodiment of the present invention.

FIG. 1 shows an inkjet printer 101 according to an embodiment of the present invention. The inkjet printer 101 is a color inkjet printer having four inkjet heads 1 for respectively ejecting four different color inks of yellow, magenta, cyan, and black. The inkjet printer 101 includes a paper feed tray 11 in a left region in FIG. 1 and a paper discharge tray 12 in a right region in FIG. 1.

In the inkjet printer 101 formed is a conveyance path in which a paper P as a recording medium is conveyed from the paper feed tray 11 toward the paper discharge tray 12. At a position immediately downstream of the paper feed tray 11, a pair of feed rollers 5*a* and 5*b* are positioned for pinching the paper to convey. The pair of feed rollers 5*a* and 5*b* takes the paper P out of the paper feed tray 11 and sends the paper P rightward in FIG. 1. In the middle of the conveyance path, a belt conveyor mechanism 13 is provided that includes two belt rollers 6 and 7; an endless conveyor belt 8 wrapped on the rollers 6 and 7 to be stretched between the rollers; and a platen 15 positioned in the region surrounded by the conveyor belt 8 so as to be opposed to the inkjet heads 1. The platen 15 supports a portion of the conveyor belt 8 being opposed to the inkjet heads 1 so that the portion of the belt does not bend downward. A nip roller 4 is positioned so as to be opposed to the belt roller 7. The nip roller 7 presses onto the outer surface of the conveyor belt 8 the paper P sent from the paper feed tray 11 by the feed rollers 5*a* and 5*b*. A not-shown conveyance motor drives the belt roller 6 to rotate, and thereby the conveyor belt 8 is run. The conveyor belt 8 carries the paper P pressed onto the outer surface of the belt by the nip roller 4 and adhering to the outer surface of the belt, and in this state, the belt 8 conveys the paper P toward the paper discharge tray 12. A peeling plate 14 is provided immediately downstream of the conveyor belt 8 in the conveyance path. The peeling plate 14 peels off from the outer surface of the conveyor belt 8 the paper P adhering to the outer surface of the belt.

Four inkjet heads 1 are arranged in the conveyance direction of the paper P, and fixed so as to face the conveyance path. That is, the inkjet printer 101 is a line type printer. Each inkjet head 1 has at its lower end a head main body 2. The head main body 2 has a rectangular parallelepiped shape extending perpendicularly to the conveyance path. The bottom face of the head main body 2 is formed into an ink ejection face 2*a* facing a conveyance surface 8*a* that is an upper part of the outer surface of the conveyor belt 8. While the paper P being conveyed by the conveyor belt 8 sequentially passes just below the four head main bodies 2, the ink ejection fades 2*a* eject ink droplets of respective colors toward the upper surface of the paper P, that is, the print surface. Thus, a desired color image is formed on the paper P.

Figure 2:
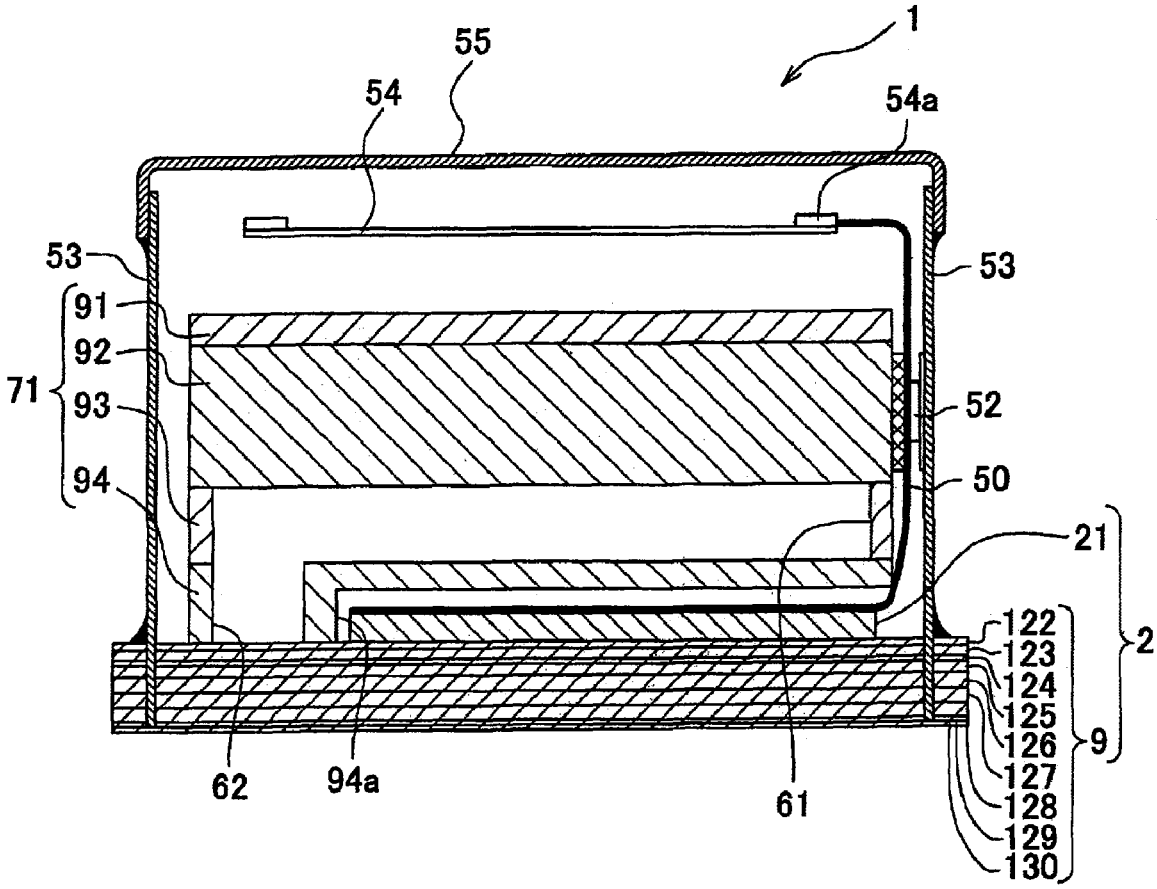
FIG. 2 is a lateral sectional view of an inkjet head included in the printer of FIG. 1.

Next, each inkjet head 1 will be described in detail with reference to FIG. 2. As shown in FIG. 2, the inkjet head 1 includes a head main body 2 including a passage unit 9 and an actuator unit 21; a reservoir unit 71 positioned on the upper face of the head main body 2 for supplying ink into the head main body 2; a chip-on-film (COF) 50 on which a driver IC 52 is formed for generating a pulse train signal as a drive signal to drive the actuator unit 21; a substrate 54 electrically connected to the COF 50; and a side cover 53 and a head cover 55 that cover the actuator unit 21, the reservoir unit 71, the COF 50, and the substrate 54 so as to prevent external ink mist from entering.

The reservoir unit 71 has a layered structure constituted by four plates 91 to 94. In the reservoir unit 71 formed are a not-shown ink flow-in passage, an ink reservoir 61, and ten ink flow-out passages 62 though FIG. 2 shows only one ink flow passage 62. The ink flow-in passage, the ink reservoir 61, and the ink flow passages 62 are connected to each other. Ink stored in the ink reservoir 61 flows through the respective ink flow-out passages 62, and then the ink is supplied into the passage unit 9 via not-shown ink supply ports. The plate 94 has a plurality of protrusions 94*a* in which the ink flow-out passages 62 are formed. The protrusions 94*a* of the plate 94 form a space between the plate 94 and the passage unit 9. Four actuator units 21 are positioned in the space though FIG. 2 shows only one actuator unit 21.

A plurality of wires are formed on the COF 50 though they are not shown in FIG. 2. One ends of the wires are electrically connected to individual electrodes 135 and a common electrode 134 on the upper face of the actuator unit, which electrodes will be described later. The COF 50 extends upward between the side cover 53 and the reservoir unit 71. The other ends of the wires are connected to electric components on the substrate 54 via a connector 54*a*. The substrate 54 outputs to the driver IC 52 a control signal supplied from a not-shown higher-rank controller.

Figure 3:
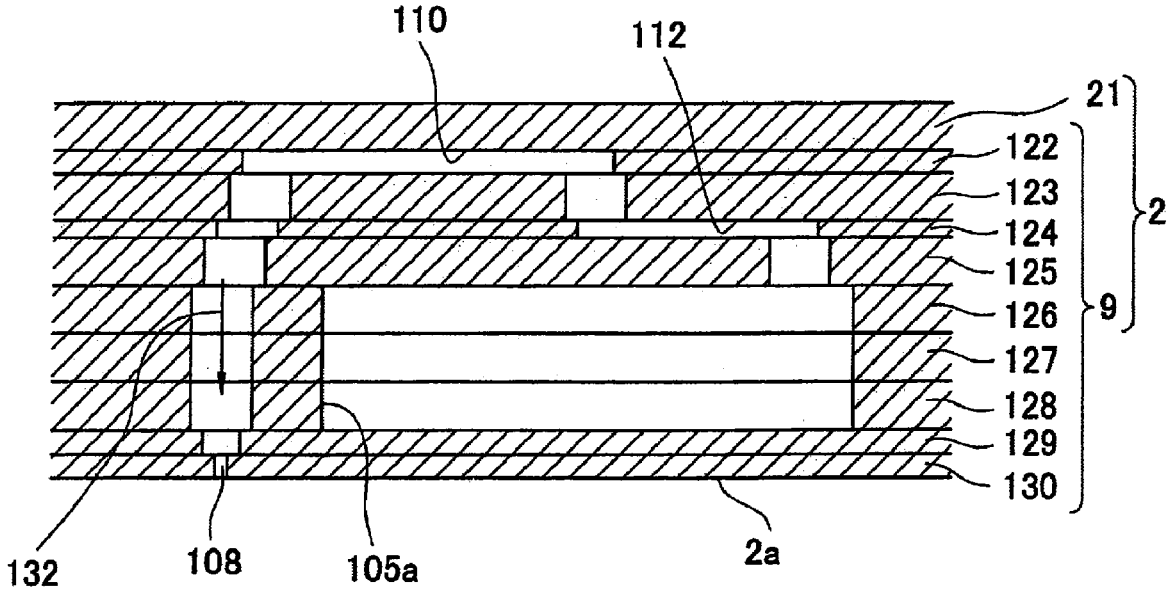
FIG. 3 is a partial sectional view of a passage unit shown in FIG. 2.

As shown in FIG. 3, the passage unit 9 is constituted by nine metal plates of, in the order of the uppermost plate, a cavity plate 122, a base plate 123, an aperture plate 124, a supply plate 125, manifold plates 126, 127, and 128, a cover plate 129, and a nozzle plate 130. These plates 122 to 130 are put in layers after being positioned to each other, so that a plurality of individual ink passages 132 are formed in the passage unit 9. Each individual ink passage 132 leads from a manifold channel 105, a sub manifold channel 105*a*, and an outlet of the sub manifold channel 105*a* through a pressure chamber 110 to a nozzle 108. On a surface of the passage unit 9, ten ink supply ports are formed that are open ends of the manifold channels 105. The ink supply ports are positioned so as to correspond to the respective ink flow-out passages 62.

Figure 4:
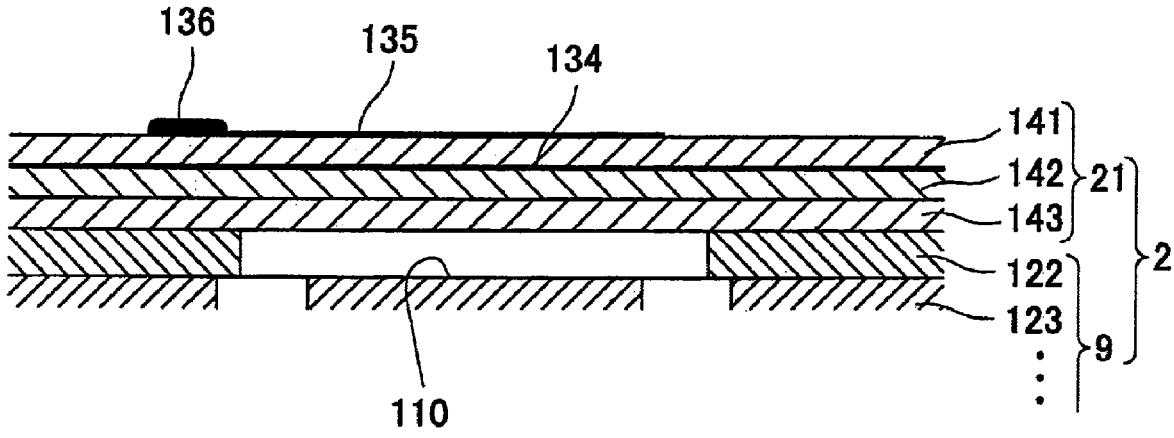
FIG. 4 is an enlarged partial sectional view of an actuator unit shown in FIG. 2.
Figure 5:
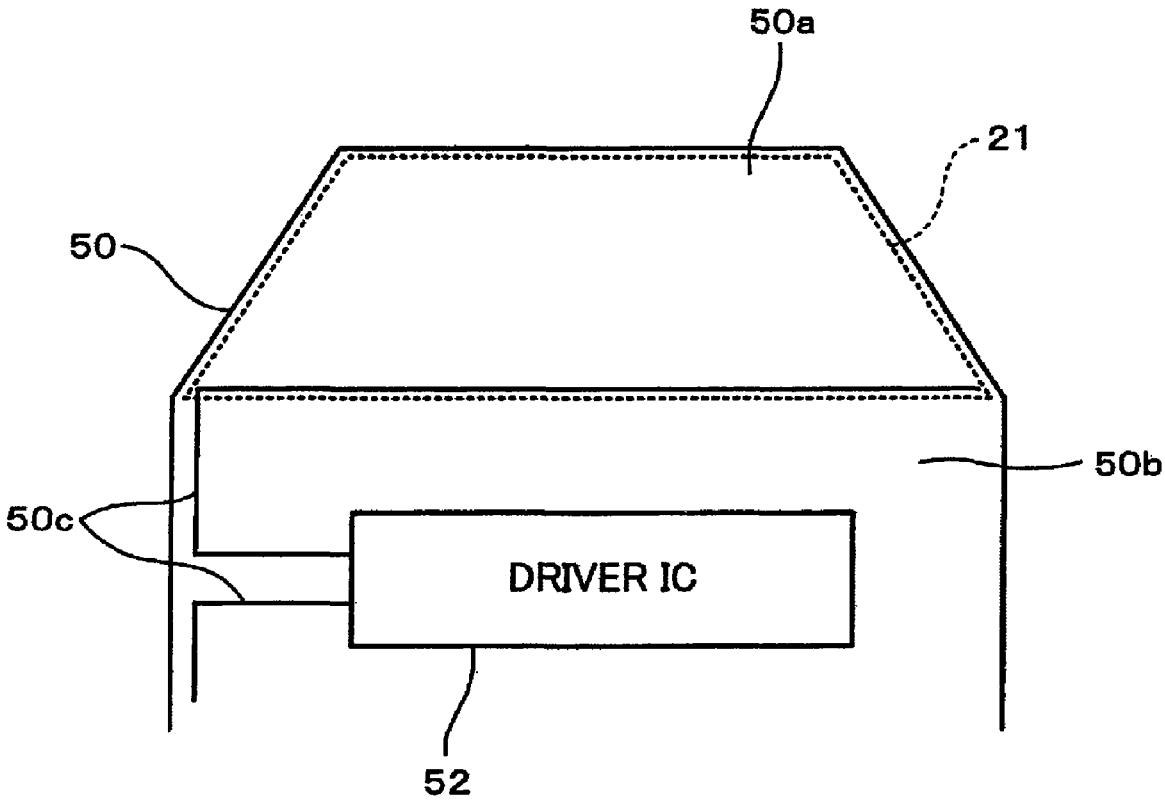
FIG. 5 is a schematic partial plan view of a chip-on-film (COF) shown in FIG. 2.

The actuator unit 21 has a trapezoidal shape in a plan view, as shown in FIG. 5. The actuator unit 21 is constituted by three piezoelectric layers 141 to 143 each made of a piezoelectric zirconate titanate (PZT)-base ceramic material having ferroelectricity. Individual electrodes 135 are formed on the uppermost piezoelectric layer 141 at positions corresponding to the respective pressure chambers 110. As shown in FIG. 4, each individual electrode 135 has an electrode portion being opposed to the corresponding pressure chamber 110, and an extension extending out of the region opposed to the pressure chamber 110. A land 136 is formed on the extension. A common electrode 134 formed over the whole sheet area is interposed between the uppermost piezoelectric layer 141 and the second uppermost piezoelectric layer 142.

Figure 6:
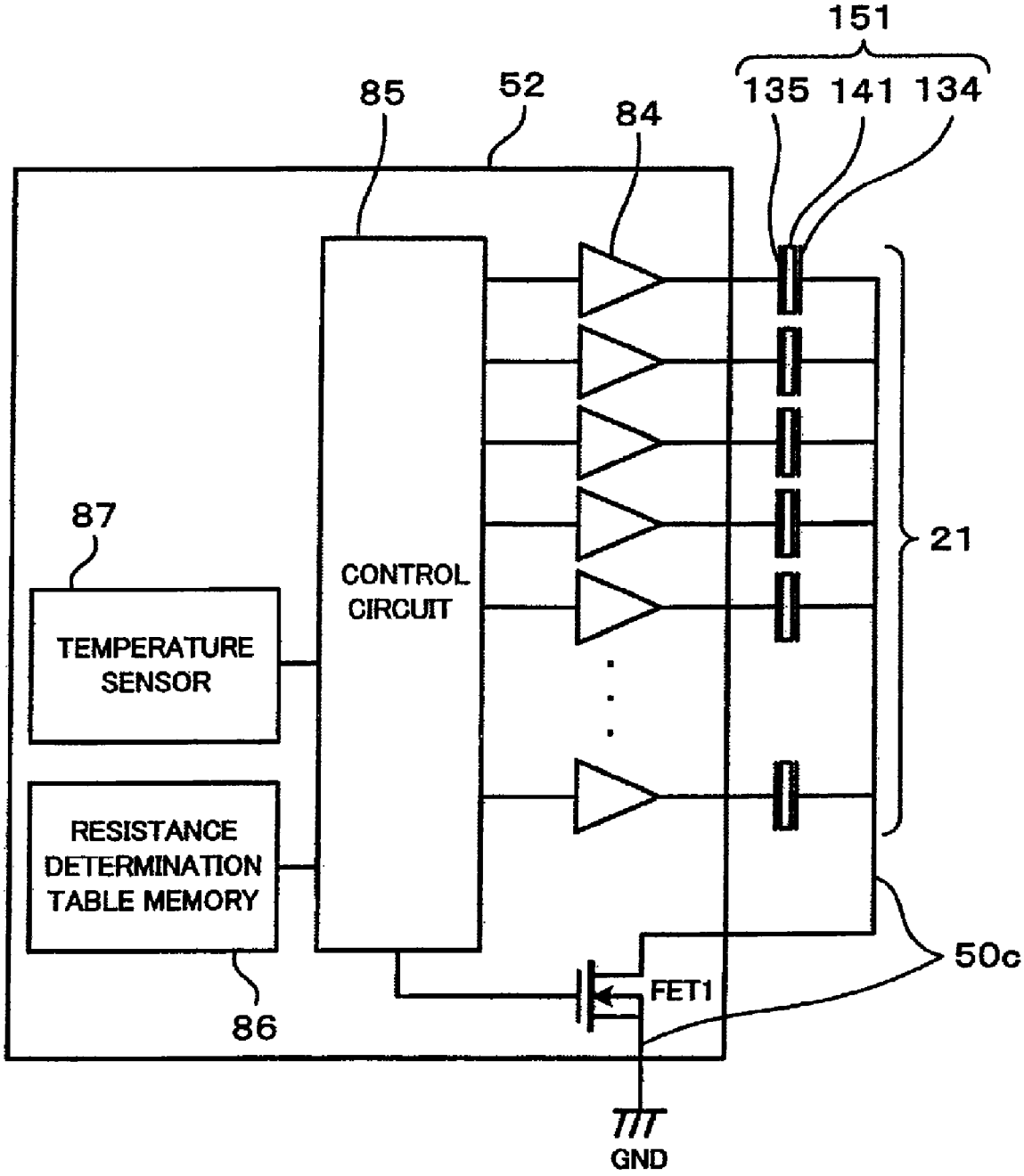
FIG. 6 is a block diagram showing a functional construction of a driver IC shown in FIG. 5.

The common electrode 134 is grounded via a field effect transistor FET1, which will be described later, so that a reference potential is given to the common electrode 134 evenly in the regions corresponding to all pressure chambers 110. On the other hand, the individual electrodes 135 are electrically connected via their lands 136 and internal wires of the COF 50 to respective waveform output circuits 84 in the driver IC 52, as shown in FIG. 6. Thus, the driver IC 52 can supply a pulse signal to only one or more desired individual electrodes 135. That is, the portions of the actuator unit 21 overlapping the respective individual electrodes 135 in a plan view function as individual actuators. In other words, the same number of actuators as the pressure chambers 110 are constructed in the actuator unit 21.

Next, a driving method of the actuator unit 21 will be described. The piezoelectric layer 141 has been polarized along its thickness. On the other hand, the piezoelectric layers 142 and 143 are inactive layers that are not deformed by their own actions. The piezoelectric layers 141 to 143 are fixed to the upper face of the cavity plate 122 that defines the pressure chambers 110. Thus, when an individual electrode 135 is put at a potential different from that of the common electrode 134 to apply an electric field to the piezoelectric layer 141 in the polarization direction, the portion of the piezoelectric layer 141 to which the electric field has been applied serves as an active portion to be deformed by the piezoelectric effect. When the electric field is applied in the same direction as the polarization of the piezoelectric layer 141, the active portion increases in its thickness and decreases in its area. When a difference in the quantity of deformation in area is generated between the portion of the piezoelectric layer 141 to which the electric field has been applied, and the piezoelectric layers 142 and 143 below the portion of the piezoelectric layer 141, the whole of the piezoelectric layers 141 to 143 is unimorph-deformed so as to be convex toward the corresponding pressure chamber 110. Thereby, pressure, that is, ejection energy, is given to ink in the pressure chamber 110 to generate a pressure wave in the pressure chamber 110. The generated pressure wave propagates from the pressure chamber 110 to the corresponding nozzle 108 to eject ink droplets from the nozzle 108.

In this embodiment, any individual electrode 135 is in advance put at a predetermined potential different from the ground potential. Every time when an ejection request is issued, the driver IC 52 outputs a pulse signal to a target individual electrode 135 so that the individual electrode 135 is once put at the ground potential and then again put at the predetermined potential at a predetermined timing. In this case, at the timing when the individual electrode 135 is put at the ground potential, the pressure of ink in the corresponding pressure chamber 110 lowers so that ink is sucked from the corresponding sub manifold channel 105*a* into the corresponding individual ink passage 132. Afterward, at the timing when the individual electrode 135 is again put at the predetermined potential, the pressure of ink in the pressure chamber 110 rises so that ink droplets are ejected from the nozzle 108. That is, a rectangular pulse signal is given to the individual electrode 135. The width of the pulse is substantially equal to the acoustic length (AL) that is the time length in which the pressure wave in the pressure chamber 110 propagates from the outlet of the sub manifold channel 105*a* to the tip end of the nozzle 108. In this design, the positive pressure wave having returned by reflection with having been inverted in phase is superimposed on the positive pressure newly applied by the actuator unit 21. As a result, large pressure can be applied to ink in the pressure chamber 110.

Next, the COF 50 and the driver IC 52 will be described with reference to FIGS. 5 and 6. FIG. 5 is a schematic partial plan view of the COF 50. FIG. 6 is a block diagram showing a functional construction of the driver IC 52. In FIG. 6, a separate common electrode 134 and a separate piezoelectric layer 141 are provided for each individual electrode 135. Actually, however, only a single common electrode 134 and only a single piezoelectric layer 131 are provided in one actuator unit 21, as described above.

As shown in FIG. 5, the COF 50 has a trapezoidal connection region 50*a* in which the actuator unit 21 is connected; and an extension region 50*b* bordering the long side of the connection region 50*a* and extending perpendicularly to that long side. The driver IC 52 is positioned in the extension region 50*b*. Common lines 50*c* are formed in an outer peripheral portion of the extension region 50*b*. The common lines 50*c* are formed as a wiring pattern grounded via a field effect transistor FET1 provided in the driver IC 52.

As shown in FIG. 6, the driver IC 52 includes the same number of waveform output circuits 84 as the individual electrodes 135; a control circuit 85 serves as a controller; a resistance determination table memory 86; a temperature sensor 87; and a field effect transistor FET1, which are contained in a single package. Each waveform output circuit 84 is connected to one individual electrode 135 to supply a pulse signal to the electrode. The temperature sensor 87 is for detecting the environmental temperature around the inkjet head 1. The temperature sensor 87 is made of a semiconductor constituting the driver IC 52. The energy gap or barrier of the semiconductor changes with temperature, and it lowers as the temperature rises. The temperature sensor 87 uses the characteristic of the semiconductor, and outputs to the control circuit 89 the voltage corresponding to the energy gap or barrier, as a detection result.

The gate of the field effect transistor FET1 is connected to the control circuit 85. The drain of the transistor is connected to the common electrode 134 via a common line 50*c* of the COF 50. The source of the transistor is grounded. That is, the field effect transistor FET1 is connected in series with the common electrode 134 of the actuator unit 21.

Figure 7:
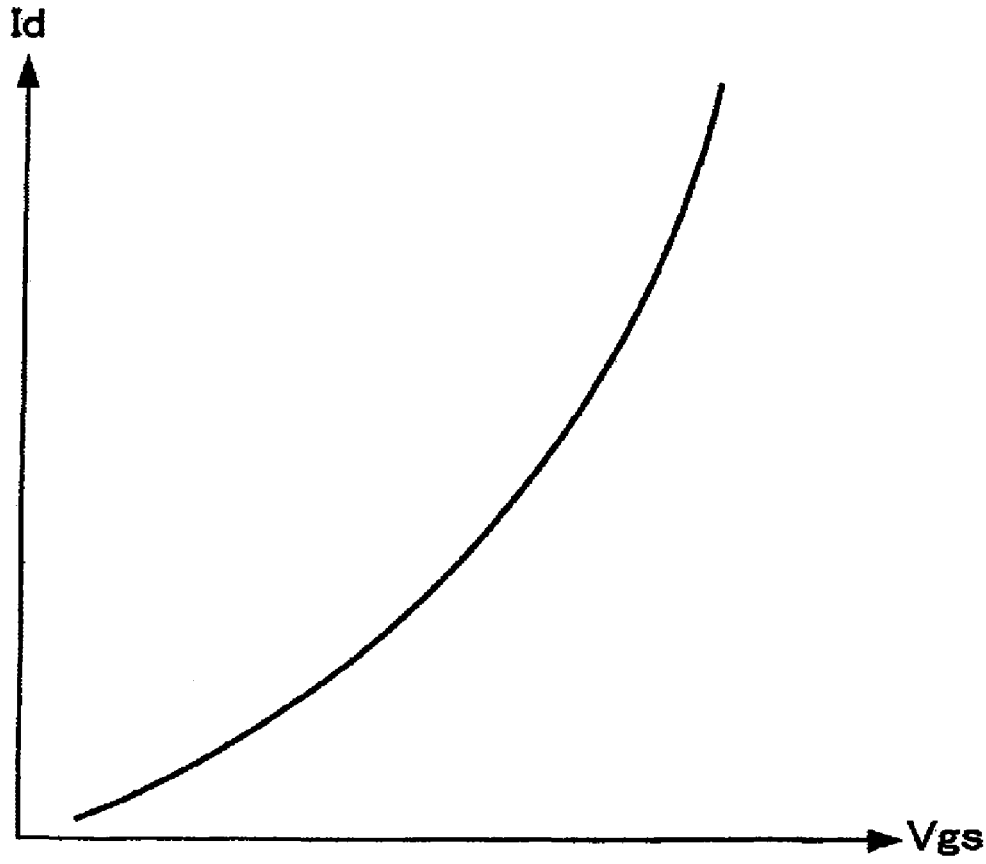
FIG. 7 is a graph showing the gate voltage characteristic of a field effect transistor (FET) shown in FIG. 6.

FIG. 7 is a graph showing the gate voltage characteristic of the field effect transistor FET1. As shown in FIG. 7, in the field effect transistor FET1, the drain current Id increases as the gate voltage Vgs increases. That is, the field effect transistor FET1 can serve as a variable resistance element whose resistance value changes with the gate voltage.

Figure 8:
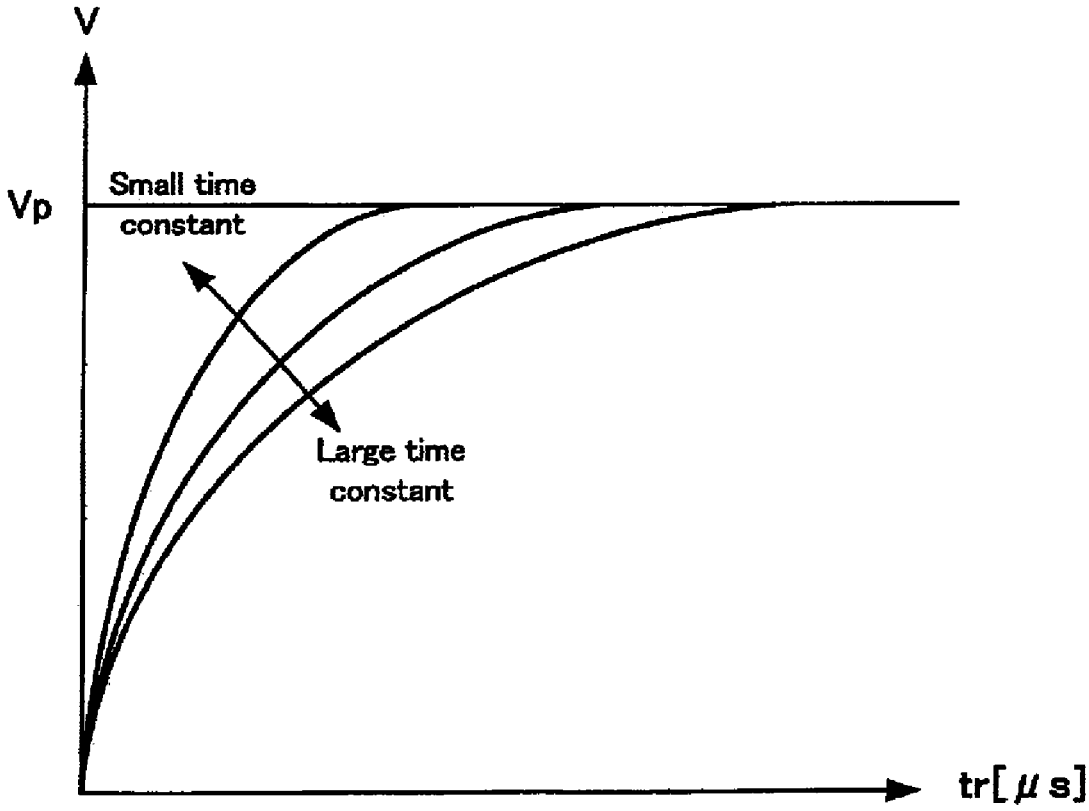
FIG. 8 is a graph showing a relation between a temporal change in the voltage between the electrodes of a capacitor and the time constant.

The actuator unit 21 is electrically equivalent to an aggregation of capacitors 151 in each of which a piezoelectric layer 141 is interposed between an individual electrode 135 and a common electrode 134. Thus, as shown in FIG. 8, when a voltage is applied between the individual and common electrodes 135 and 134 of one capacitor 151, electric charges are being accumulated in both electrodes with elapse of the time t. As the quantity of accumulated charges increases, the voltage between the electrodes increases. This increases the quantity of deformation of the capacitor 151 in the actuator unit 21. When the quantity of the charges accumulated between the individual and common electrodes 135 and 134 reaches the saturation quantity Vp, the quantity of deformation of the capacitor 151 becomes the maximum. Afterward, when the individual electrode 135 is put at the ground potential, the charges accumulated between the individual and common electrodes 135 and 134 start to flow out through the common electrode 134 to the ground via the field effect transistor FET1. Thus, the voltage between the electrodes decreases, and the quantity of deformation of the capacitor 151 decreases.

When a fixed pulse voltage is applied to the individual electrodes 135 of capacitors 151 in the actuator unit 21, the rise time Tr and fall time Tf of the pulse voltage are determined by the time constant of a CR circuit that is the product of the capacitance C of each capacitor 151 and the resistance R of the field effect transistor FET1. Specifically, as shown in FIG. 8, the rise time Tr and fall time Tf decrease of the pulse voltage to be applied to the capacitors 151 as the time constant of the CR circuit decreases. That is, the time decreases required for deformation of each capacitor 151. This increases the ejection energy to be given to ink in the corresponding pressure chamber 110. Conversely, the rise time Tr and fall time Tf increase of the pulse voltage to be applied to the capacitors 151 as the time constant of the CR circuit increases. That is, the time increases required for deformation of each capacitor 151. This decreases the ejection energy to be given to ink in the corresponding pressure chamber 110.

Figure 9:
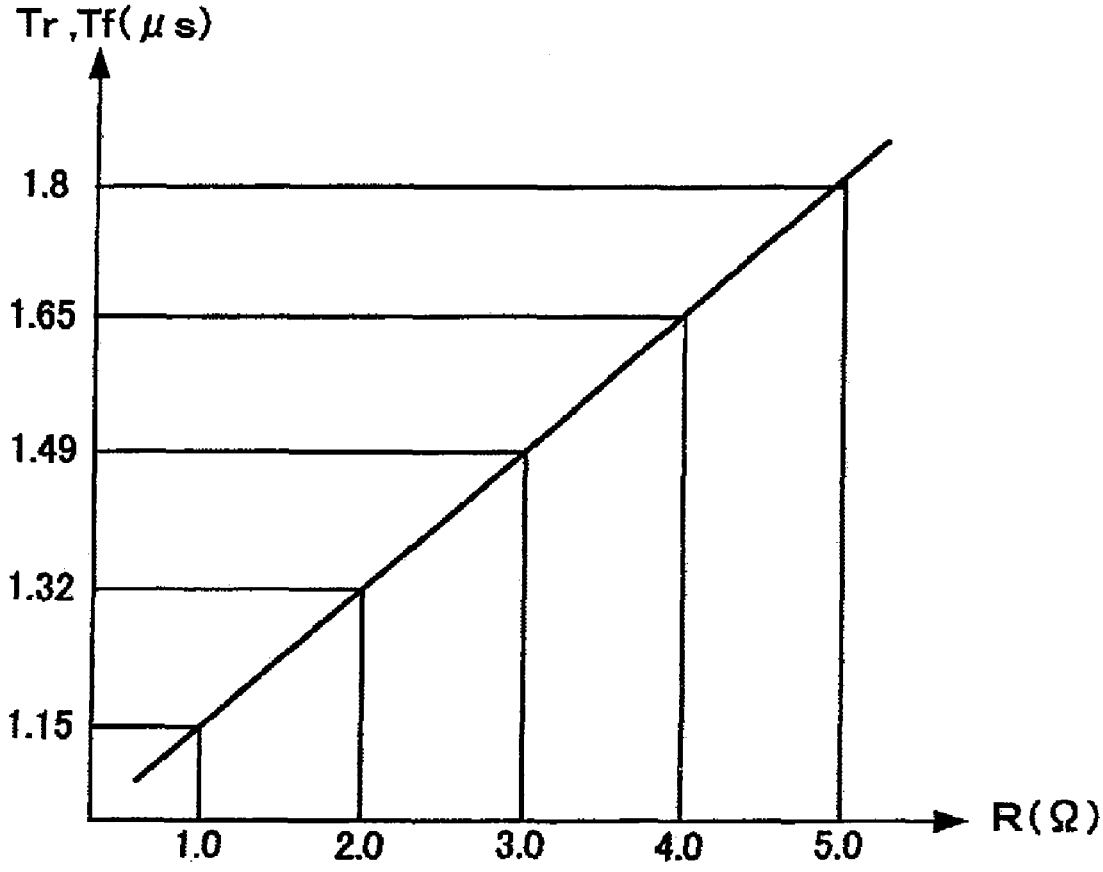
FIG. 9 is a graph showing a relation of the resistance value of a CR circuit to the rise time Tr and the fall time Tf of a pulse voltage applied to a capacitor.

When the capacitors 151 have a fixed capacitance, as shown in FIG. 9, the rise time Tr and fall time Tf of the pulse voltage to be applied to each capacitor 151 change linearly to the change in the resistance of the CR circuit.

In this embodiment, the time constant of the CR circuit with respect to the actuator unit 21 depends on the number of individual electrodes 135 to which a pulse signal is to be given, that is, the number of capacitors to be activated, and the resistance between the common electrode 134 and the ground, that is, the resistance between the drain and source of the field effect transistor FET1.

The control circuit 85 controls the waveform output circuits 84 on the basis of image data on an image to be printed on a paper P. In addition, the control circuit 85 controls the gate voltage of the field effect transistor FET1 on the basis of the detection result of the temperature sensor 87 and the number of nozzles to eject at once. The control circuit 85 changes the gate voltage of the field effect transistor FET1 to control the resistance of the field effect transistor FET1. This control determines the time constants of the CR circuits constituted by the respective capacitors 151 in the actuator unit 21 and the field effect transistor FET1 in the driver IC 52.

The resistance determination table memory 86 stores therein a resistance determination table used for the control circuit 85 to determine a resistance value of the field effect transistor FET1. The following Table 1 shows an example of a resistance determination table. Table 1 shows values of resistance R. In another example, however, the table may show values of gate voltage.

The resistance determination table shown in Table 1 is for define a resistance value of the field effect transistor FET1 in each of five ranges of the number of nozzles to eject at once, that is, 1 to 100, 101 to 200, 201 to 300, 301 to 400, and 401 to 664, for each of three environmental temperature ranges of a low temperature range, for example,

TABLE 1

| | R(Ω) | | |
|---|---|---|---|
| The number of nozzles to eject at once | Low temperature | Normal temperature | High temperature |
| 1~100 pin | 4 | 5 | 6 |
| 101~200 pin | 3 | 4 | 5 |
| 201~300 pin | 2 | 3 | 4 |
| 301~400 pin | 1 | 2 | 3 |
| 401~664 pin | 0.5 | 1 | 2 |

20 degrees C. or less, a normal temperature range, for example, 21 degrees C. to 40 degrees C., and a high temperature range, for example, 40 degrees C. or more. In Table 1, the number of nozzles to eject at once means the number of nozzles 108 to eject ink droplets at once, and corresponds to the number of pulse signals to be output at once from waveform output circuits 84 to individual electrodes 135.

In the resistance determination table of Table 1, the resistance value of the field effect transistor FET1 decreases with a decrease in the temperature detected by the temperature sensor 87. In addition, the resistance value of the field effect transistor FET1 decreases with an increase in the number of nozzles to eject at once.

Manufacturing variation of driver ICs 52 may cause wide variation of pulse voltages output from waveform output circuits 84, from driver IC 52 to driver IC 52. In this embodiment, therefore, the pulse voltages output from the waveform output circuits 84 of driver ICs 50 to be used were measured in advance, and the resistance determination table memory 86 stores therein a resistance determination table containing resistance values in accordance with the pulse voltages output from the waveform output circuits 84. More specifically, when the pulse voltages are higher than a reference upper limit value, the resistance determination table memory 86 stores therein a resistance determination table containing resistance values of the field effect transistor FET1 higher than those of other driver ICs 52. On the other hand, when the pulse voltages are lower than a reference lower limit value, the resistance determination table memory 86 stores therein a resistance determination table containing resistance values of the field effect transistor FET1 lower than those of other driver ICs 52. In this manner, even in the case of using driver ICs 52 widely different in pulse voltage, the charge/discharge characteristics of the capacitors 151 in the actuator unit 21 can be more uniformized. This can reduce the cost of the inkjet head 1.

Each time when a pulse signal is output, the control circuit 85 determines a resistance value of the field effect transistor FET1 by referring to the resistance determination table from the temperature detected by the temperature sensor 87 and the number of nozzles to eject at once. The control circuit 85 then outputs a gate voltage to the gate terminal of the field effect transistor FET1 so that the field effect transistor FET1 has the determined resistance value.

More specifically, the control circuit 85 decreases the resistance value of the field effect transistor FET1 with a decrease in environmental temperature. This decreases the time constant of the CR circuit, and as shown in FIG. 8, increases the deformation speed of the actuator 21 so that the ink ejection amount and ejection velocity are increased. Conversely, the control circuit 85 increases the resistance value of the field effect transistor FET1 with an increase in environmental temperature. This increases the time constant of the CR circuit, and decreases the deformation speed of the actuator 21 so that the ink ejection amount and ejection velocity are decreased. The ink ejection amount and ejection velocity from a nozzle decrease as the viscosity of ink increases, while the ink ejection amount and ejection velocity from the nozzle increase as the viscosity of ink decreases. In this embodiment, therefore, because the time constant of the CR circuit is controlled so as to offset the variations in the ink ejection characteristics caused by variation in the viscosity of ink due to a change in temperature, the variations in the ink ejection characteristics can be suppressed in a broad temperature range.

The control circuit 85 decreases the resistance value of the field effect transistor FET1 in accordance with an increase in the number of pulse signals to be output at once from waveform output circuits 84. This decreases the time constant of the CR circuit constituted by the capacitors 151 in the actuator unit 21 and the field effect transistor FET1 in the driver IC 52. On the other hand, an increase in the number of pulse signals output at once from waveform output circuits 84 brings about an increase in the number of capacitors 151 in the actuator unit 21 activated by the pulse signals applied. This increases the time constant of the CR circuit constituted by the activated capacitors 151 and the field effect transistor FET1. As a result, in this embodiment, the time constant of the CR circuit is prevented from widely varying.

Conversely, the control circuit 85 increases the resistance value of the field effect transistor FET1 in accordance with a decrease in the number of pulse signals to be output at once from waveform output circuits 84. This increases the time constant of the CR circuit constituted by the capacitors 151 in the actuator unit 21 and the field effect transistor FET1 in the driver IC 52. On the other hand, a decrease in the number of pulse signals output at once from waveform output circuits 84 brings about a decrease in the number of capacitors 151 in the actuator unit 21 activated by the pulse signals applied. This decreases the time constant of the CR circuit constituted by the activated capacitors 151 and the field effect transistor FET1. As a result, also in this case, the time constant of the CR circuit is prevented from widely varying.

As described above, in this embodiment, the resistance value of the field effect transistor FET1 is changed so as to suppress variation in the time constant of the CR circuit caused by a change in the number of nozzles to eject ink droplets at once. Thus, a change in the number of nozzles to eject ink droplets at once scarcely vary the ink ejection characteristics. In addition, to use driver IC 52 each including a plurality of waveform output circuits 84, it is not necessary to select only those in which the pulse voltages are within a predetermined range. Therefore, printers 101 can be manufactured at low cost.

In addition, because a single field effect transistor FET1 is connected in series with the common electrode 134, this reduces the cost of the inkjet head 1. Further, because the CR circuit includes the field effect transistor FET1, this relatively reduces variation in the connection resistance between the common electrode 134 and the ground.

In addition, because a plurality of waveform output circuits 84 and the field effect transistor FET1 are contained in a single package, this reduces the size of the inkjet head 1.

In addition, the use of the field effect transistor FET1 whose drain current is controllable realizes an inexpensive variable resistance element.

(Modifications)

Figure 10:
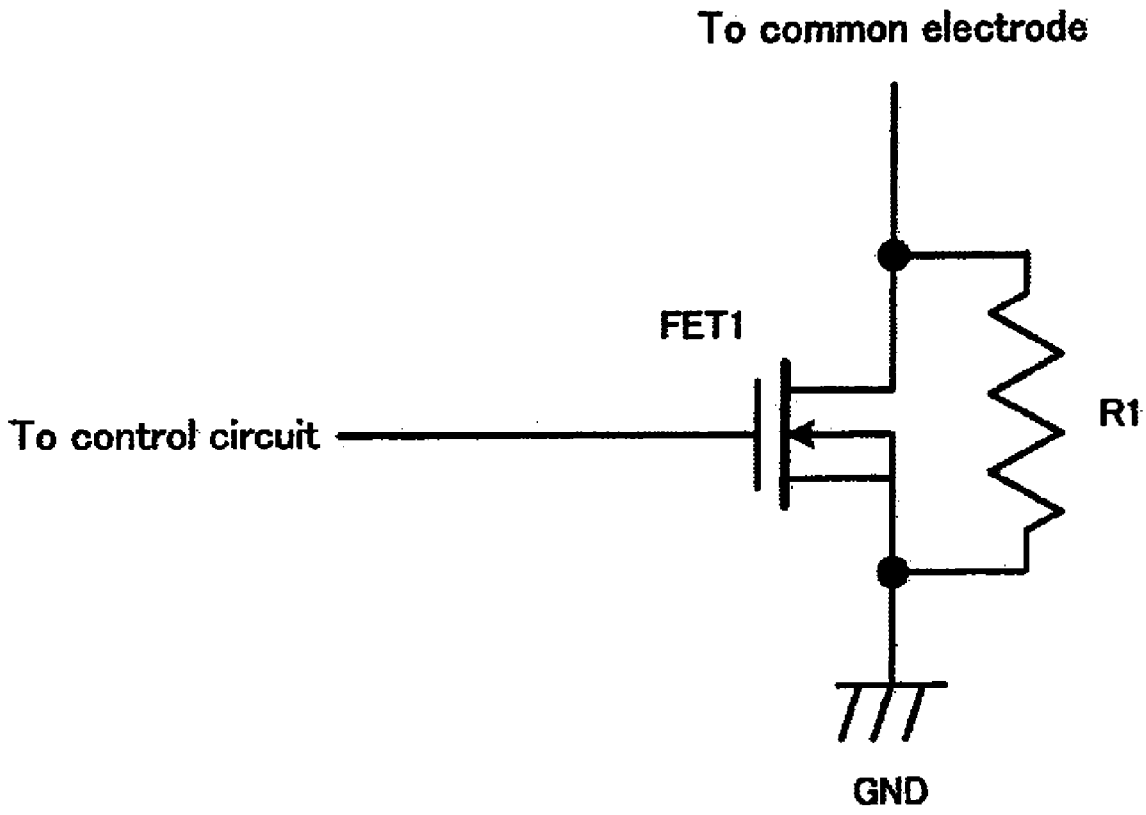
FIG. 10 shows a modification of the embodiment of the present invention.

A modification of the above-described embodiment will be described with reference to FIG. 10. In this modification, as shown in FIG. 10, a fixed resistance R1 is connected in parallel between the drain and source of the filed effect transistor FET1. This can easily lower the resistance between the actuator unit 21 and the ground. Thus, a highly accurate inexpensive field effect transistor FET1 having a broad adjustable range of its resistance value can be used as a variable resistance element.

Figure 11:
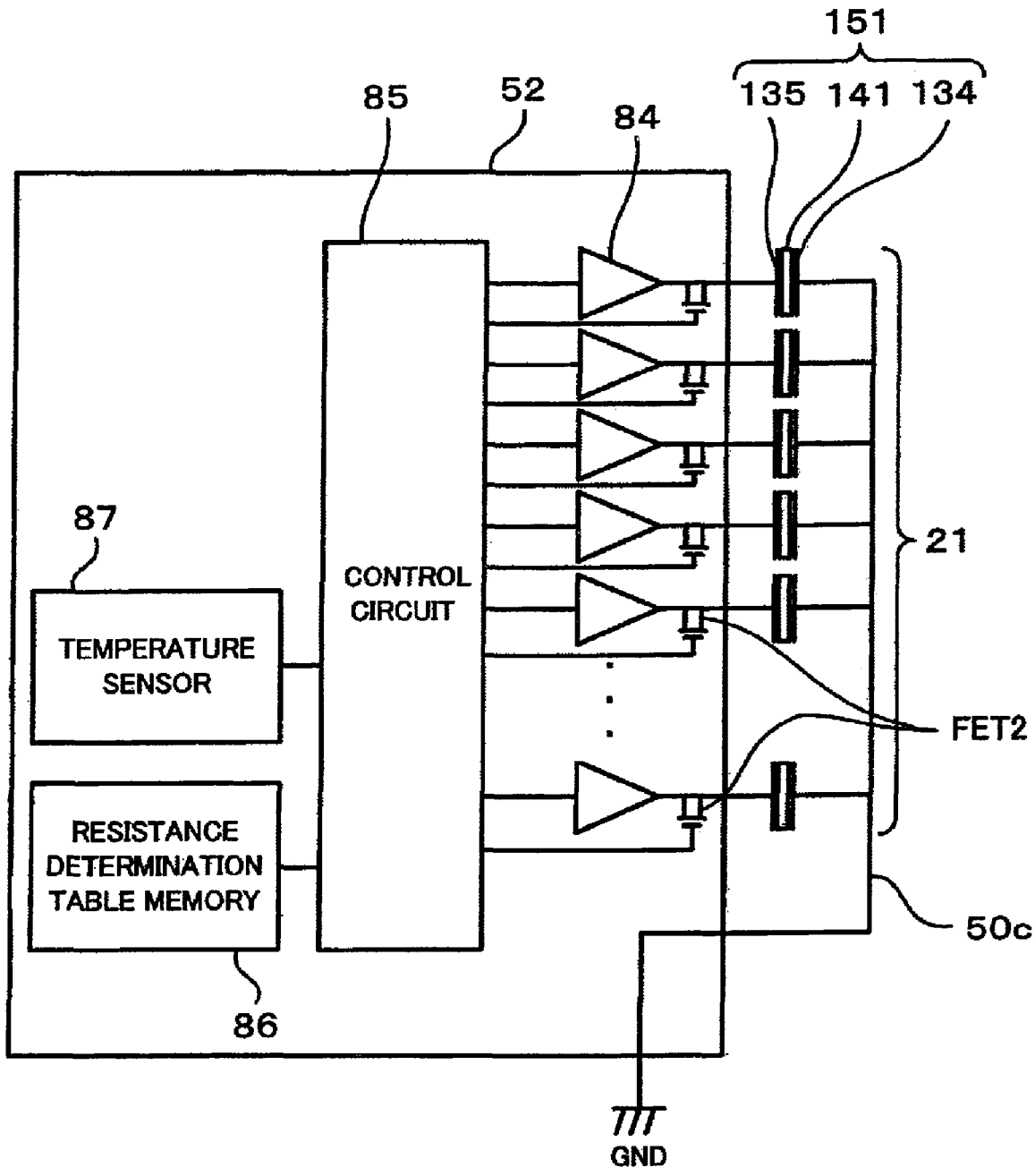
FIG. 11 shows another modification of the embodiment of the present invention.

Another modification of the above-described embodiment will be described with reference to FIG. 11. In this modification, as shown in FIG. 11, filed effect transistors FET2 as variable resistance elements are connected to respective nodes between waveform output circuits 84 and individual electrodes 135, that is, in series with the respective waveform output circuits 84 and the respective individual electrodes 135. Thereby, the same number of parallel CR circuits as the individual electrodes 135 are formed. Thus, the time constants of the CR circuits can be controlled independently. Therefore, by preparing in advance a plurality of resistance determination tables and using one of them in accordance with the charge/discharge characteristics of the capacitors 151, variation in ejection characteristics from nozzle to nozzle can be reduced. Also in this modification, each field effect transistor FET2 can have a fixed resistance connected in parallel, as described with reference to FIG. 10.

In the above-described embodiment, the resistance value of the field effect transistor FET1 is changed on the basis of the environmental temperature and the number of nozzles to eject at once. In a modification, however, the resistance value of the field effect transistor FET1 may be changed on the basis of only the environmental temperature. Conversely in another modification, the resistance value of the field effect transistor FET1 may be changed on the basis of only the number of nozzles to eject at once. In the latter modification, it is desirable that the number of capacitors to be driven at once, that is, charged/discharged at once, is sufficiently small.

In the above-described embodiment, the field effect transistor FET1 is contained in the package of the driver IC 52. In a modification, however, the driver IC may only control the gate voltage of the field effect transistor FET1 and a variable resistance element like the field effect transistor FET1 may be positioned outside of the driver IC.

In the above-described embodiment, the field effect transistor FET1 is used as a variable resistance element. In the present invention, however, any other known variable resistance element such as another kind of a transistor can be used. For example, a resistance control IC can be used such as an electronic volume device used for volume control of an audio device.

In the above-described embodiment, the temperature sensor 87 is positioned in the driver IC. In a modification, however, the temperature sensor 87 may be positioned outside of the driver IC. Also, any number of variable resistance elements may be connected in series with the common electrode, and any number of variable resistance elements may be connected between an individual electrode and a waveform output circuit. Further, any number of fixed resistance elements may be connected in parallel with any number of variable resistance elements.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a passage unit in which a plurality of individual ink passages each leading to a nozzle via a pressure chamber are formed;

an actuator unit comprising a plurality of individual electrodes related to the respective pressure chambers, a common electrode, and a piezoelectric layer interposed between the plurality of individual electrodes and the common electrode;

a plurality of waveform output circuits which output pulse signals to be supplied to the plurality of individual electrodes;

one or more variable resistance elements connected to the actuator unit;

a temperature sensor which detects environmental temperature; and a controller which controls the one or more variable resistance elements so that the one or more variable resistance elements decrease in their resistance values with a decrease in the environmental temperature detected by the temperature sensor.

2. The apparatus according to claim 1, wherein the controller controls the one or more variable resistance elements so that the one or more variable resistance elements decrease in their resistance values with an increase in the number of pulse signals to be output at once from the plurality of waveform output circuits.

3. The apparatus according to claim 1, wherein one variable resistance element is connected in series with the common electrode.

4. The apparatus according to claim 1, wherein a plurality of variable resistance elements are connected between the plurality of individual electrodes and the plurality of waveform output circuits, respectively.

5. The apparatus according to claim 1, further comprising one or more fixed resistance elements connected in parallel with the one or more variable resistance elements.

6. The apparatus according to claim 1, wherein the plurality of waveform output circuits and the one or more variable resistance elements are contained in a single package.

7. The apparatus according to claim 1, wherein each variable resistance element is constructed so that the current to flow through the variable resistance element can be controlled.

* * * * *